United States Patent [19]

Gordon et al.

[11] Patent Number: 4,575,000

[45] Date of Patent: Mar. 11, 1986

[54] FOOD WRAPPER PACKAGE

[75] Inventors: Robert L. Gordon, Monroe; Michael G. Bodary, Middletown, both of N.Y.

[73] Assignee: International Paper Company, New York, N.Y.

[21] Appl. No.: 669,977

[22] Filed: Nov. 9, 1984

[51] Int. Cl.[4] ..... B65D 75/38

[52] U.S. Cl. ..... 229/87 F; 229/40; 229/DIG. 13

[58] Field of Search ..... 229/87 R, 87 F, 40, 229/87 B, 3.5 R, DIG. 13; 206/45.31, 45.33

[56] References Cited

U.S. PATENT DOCUMENTS

| | | | |
|---|---|---|---|
| Re. 23,096 | 4/1949 | Mullinix | 229/87 F |
| 203,427 | 5/1878 | Daul . | |
| 477,015 | 6/1892 | Maloney . | |
| 1,135,878 | 4/1915 | Christensen | 229/87 F |
| 1,474,088 | 11/1923 | Reynolds . | |
| 1,630,542 | 5/1927 | Schulz . | |
| 1,950,643 | 3/1934 | Vogt | 206/56 |
| 2,019,191 | 10/1935 | Milmoe | 229/87 F |
| 2,127,029 | 8/1938 | Hermanson | 229/87 |
| 2,333,943 | 11/1943 | Levkoff | 229/14 |
| 2,335,019 | 11/1943 | Mullinix | 229/87 |
| 2,372,735 | 4/1945 | Palmer | 229/87 F |
| 2,465,841 | 3/1949 | Bonini | 229/87 |
| 2,553,923 | 5/1951 | Lambert | 206/59 |
| 2,835,435 | 5/1958 | Mullinix | 229/87 F |
| 2,870,023 | 1/1959 | Vogt | 99/179 |
| 2,987,402 | 6/1961 | Dold | 99/171 |
| 3,027,263 | 3/1962 | Wanamaker | 229/87 B |
| 3,515,333 | 6/1970 | Kotkas et al. | 229/40 |
| 3,964,669 | 6/1976 | Sontag | 229/40 |

FOREIGN PATENT DOCUMENTS

| | | | |
|---|---|---|---|
| 551637 | 3/1943 | United Kingdom | 229/87 F |

*Primary Examiner*—William Price
*Assistant Examiner*—Bryon Gehman
*Attorney, Agent, or Firm*—Richard J. Ancel

[57] ABSTRACT

A wrapper for a food product such as a hamburger which is defined by an outer layer of paperboard and an inner layer of glassine type of paper. The outer and inner layers are of generally rectangular form, the glassine type of paper extending beyond the side edges of the paperboard and having top and bottom edges, a major portion of each edge having radiused cutouts. The paperboard and glassine type of paper are joined by a narrow adhesive strip running lengthwise and centrally of them. The ends of the paperboard have hinged and relatively narrow locking panels. In use, a food product such as a hamburger is placed on top of the glassine type of paper at its midlength. The wrapper is folded around the hamburger to form a tube, the wrapper ends being secured together by twisting the locking panels, with the glassine type of paper extending from both ends of the tube being bunched together and tucked in beneath the hamburger, between it and the paperboard.

11 Claims, 7 Drawing Figures

FOOD WRAPPER PACKAGE

BACKGROUND OF THE INVENTION

This invention relates to a wrapper for a food product, the wrapper and the food product defining a package. The wrapper displays particular utility in the packaging of certain so-called fast foods, such as hamburgers.

SUMMARY OF THE INVENTION

The wrapper is defined by a rectangular blank of stiff, resilient and foldable sheet stock such as paperboard, in combination with a generally rectangular flexible sheet such as glassine type of paper. The glassine type of paper and sheet stock are adhesively secured together along a zone of narrow width, the zone being substantially coextensive with the respective longitudinal axes of the sheet stock and the glassine type of paper. A two layer laminate is defined by the sheet stock and the flexible sheet. In use, a food product such as a hamburger is placed on top of the flattened laminate, with the hamburger being placed on the central portion of the flexible sheet. The laminate is now wrapped around the hamburger, with the free ends of the laminate being secured together to thereby define a means for locking the ends together, the resultant structure defining a tube. The width of the flexible sheet is greater than the width of the paperboard, with the glassine type of paper now being folded down and bunched together to thereby close the ends of the tube, with the ends of the extending glassine type of paper being tucked beneath the hamburger, so as to be positioned between the bottom of the hamburger and the paperboard. The tension in the glassine type of paper arising from this tucking-in operation serves to secure the locking means or latch which locks the free ends of the laminate together. The user of this package now releases the latch, or pulls out the tucked in glassine type of paper, or both, to thereby open the tube and obtain access to the food product. After opening the tube, the tube assumes a generally flat or somewhat flat form, so that the wrapper serves the additional function of a napkin or a plate over which the user may hold the food product while eating it. The use of the glassine type of paper also lends a napkin-like quality to the opened tube while eating, thereby adding to the enjoyment of the user of this product, as opposed to other food packages for fast food hamburgers which are formed of rigid plastic materials.

The prior art is aware of food wrappers somewhat similar to this invention. For example, U.S. Pat. No. 3,964,669 issued to Sontag et al discloses a wrapper for a hamburger, the wrapper defined by a flexible sheet member 12 in combination with a relatively rigid foldable material such as paperboard. The wrapper is wrapped around the hamburger to form a tube, with the extending ends of the flexible sheet being tucked in to cover the open ends of the tube. However, the construction illustrated in this patent is complicated by the use of auxiliary panels 30 and 31 on the paperboard and by the use of adhesive 20 and 26 to form a lock to hold the ends of the tube together. U.S. Pat. No. 2,987,402 issued to Dold shows a two-layer laminate which includes a cardboard member 12 in combination with flexible film 25. Again, a tube is formed by wrapping the wrapper around the food products, here in the form of frankfurters. The mode of formation of the package is different, however, with the extending ends of the flexible foil 25 being wrapped around the food product prior to the formation of the tube. To hold the tube together, a conventional tongue 23 and slot 22 arrangement is employed. The cardboard element 12 and flexible sheet 25 are secured together across substantially the entire width of the cardboard member, thereby precluding the folding under of the extending ends of the tube between the food product and the flexible sheet. U.S. Pat. No. 1,950,643 issued to Vogt shows a wrapper for ice cream which employs a lock 19, 20 somewhat similar to the lock of this invention, but the construction is otherwise dissimilar. U.S. Pat. No. 2,127,029 issued to Hermanson shows a wrapper for a food product defined by a laminate, with one layer of the laminate defined by crepe paper and the other layer of the laminate defined by wax paper. However, the mode of forming the package is different than that of the present invention. U.S. Pat. No. 2,333,943 issued to Levkoff discloses a laminate wrapper for a food product defined by cardboard and cellophane. However, the mode of formation of the package is not similar to that of the present invention.

The full nature of the invention will be understood from the accompanying drawing and the following description and claims. It should be understood, however, that references in the following description to terms such as left, right, base, front, rear, and side wall members are for convenience of description, and such terms are not intended to be used in a limiting sense.

DETAILED DESCRIPTION OF THE INVENTION

Figure 1:
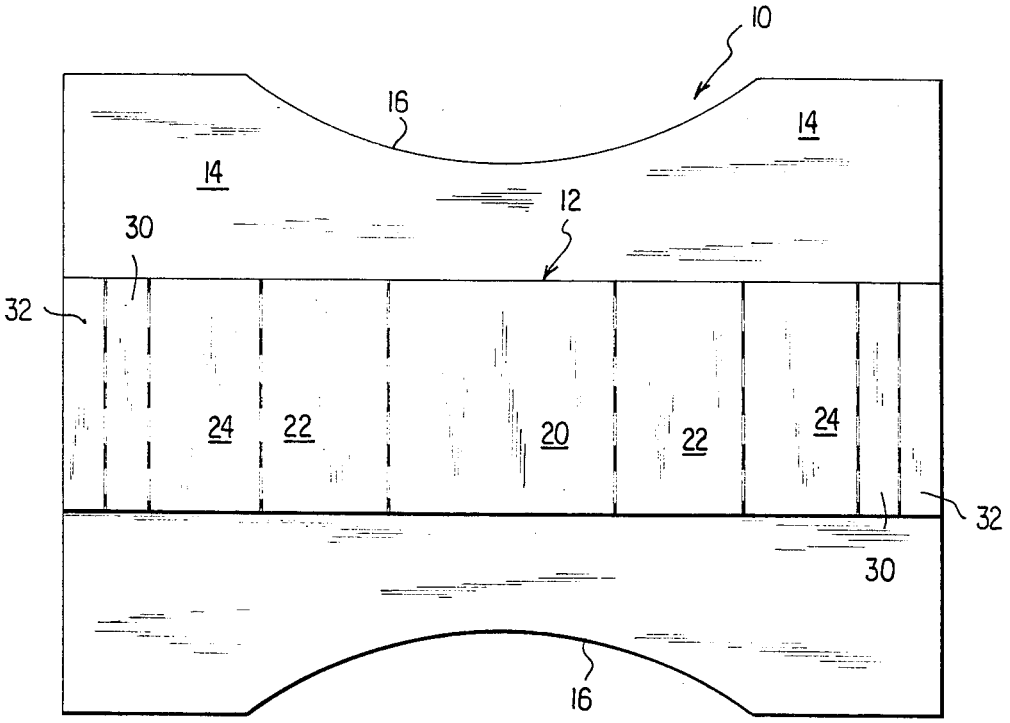
FIG. 1 is a plan view of the wrapper of this invention.
Figure 2:
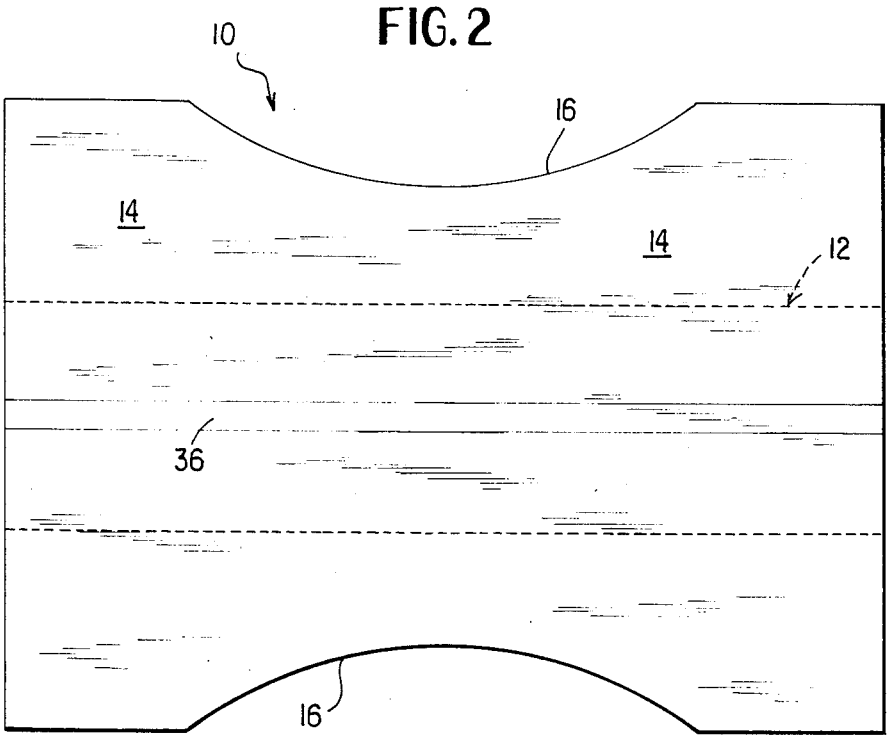
FIG. 2 is a view similar to FIG. 1 but showing the other side or surface of the wrapper.

Referring now to FIGS. 1 and 2 of the drawings, the numeral 10 denotes generally the wrapper of this invention and is defined by a two-layer laminate. The first layer is denoted by the numeral 12 and is defined by a generally rectangular sheet of paperboard having a plurality of fold lines transverse to its longitudinal axis, the fold lines defining a plurality of foldable panels. The numeral 14 denotes a sheet of glassine type of paper, also of generally rectangular form, with its longitudinal axis being substantially coincident with the longitudinal axis of paperboard 12. Tissue paper 14 is provided along a major portion of each of its top and bottom edges with a cutout, preferably radiused, denoted generally by the numeral 16. As will be more apparent from the description which follows, the purpose of these cutouts is to reduce the amount of the glassine type of paper which will be tucked in to define the package, thereby eliminating excessive bunching or gathering of the glassine type paper when it is tucked between the food item and the base of the paperboard wrapper. FIG. 2 illustrates a relatively narrow zone 36 extending along the longitudinal axis of the wrapper 10, this zone defining an adhesive area for securing the paperboard 12 to the glassine type of paper 14. It will be observed that the zone 36 is relatively narrow and extends from one end of the wrapper to the other end.

The paperboard 12 is defined by a plurality of panels. The central panel is denoted by the numeral 20 and is adapted to form the bottom panel of the completed package. A first pair of laterally displaced panels 22 is positioned at the ends of panel 20, with a second pair of lateral panels 24 secured to respective panels 22. The numerals 30 and 32 denote locking panels or locking means whose action will presently be described.

Figure 3:
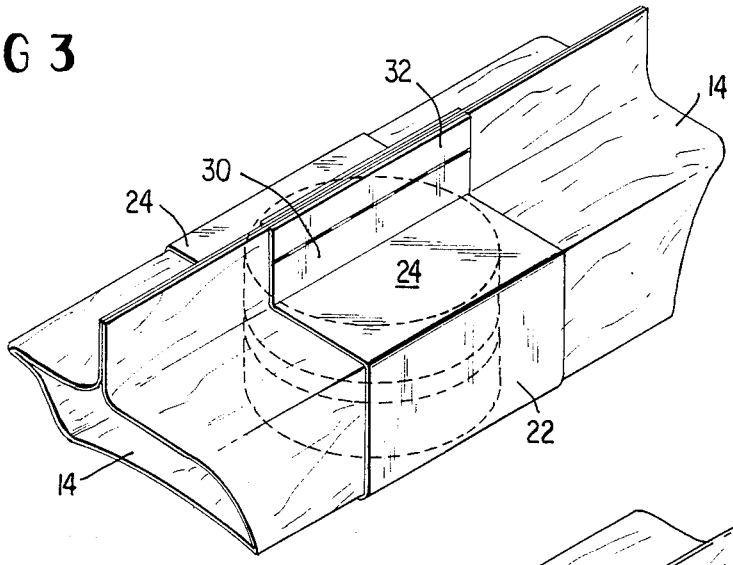
FIG. 3 is a view illustrating the initial step in formation of the package of this invention.
Figure 4:
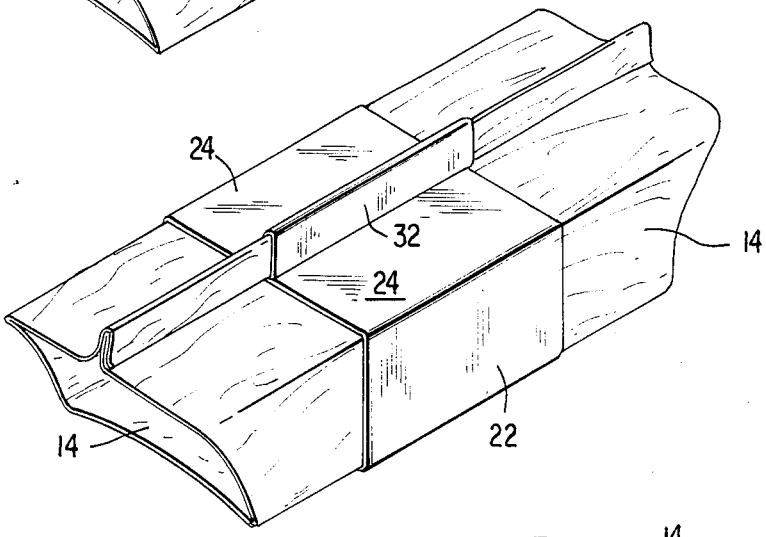
FIG. 4 is a view similar to FIG. 3 and illustrates the second step in formation of the package of this invention.
Figure 5:
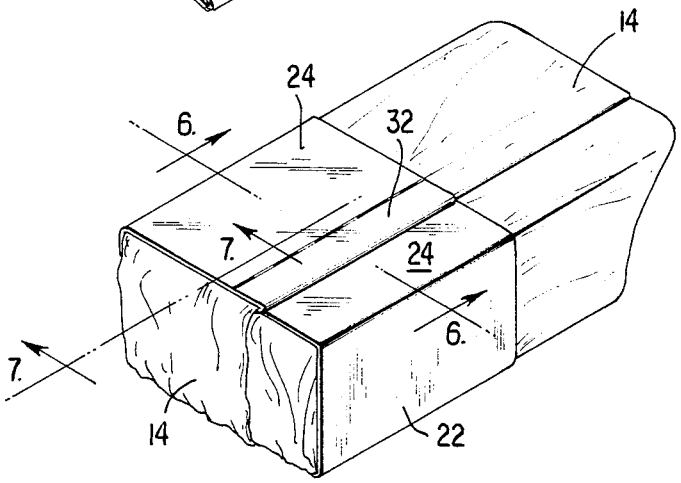
FIG. 5 is a view showing the complete formation of one end of the food package of this invention.

Referring now to FIGS. 3, 4 and 5, the description will be given of the mode of use of the wrapper 10 to define a food package, such as a food package containing a hamburger. Initially, the hamburger, shown in dashed lines at FIG. 3, is placed on top of glassine type of paper 14 as shown at FIG. 2. The hamburger will then rest on that part of the glassine type of paper which is opposite central panel 20 of the paperboard 12. The ends of the wrapper 10 are now bent upwardly, so that first lateral panels 22 form sidewalls of a tube, as indicated in FIG. 3. Next, second lateral panels 24, which define top package panels, are folded over the top of the hamburger, with the respective locking panels 30 and 32 being opposite one another and in abutting relationship as shown at FIG. 3. Next, outermost locking panels 30, 32, are grasped and are rotated about the line of hinging between panels 30 and 32, so that panels 32 rotate substantially 180°, towards the reader when viewing FIG. 3, so as to assume the position shown at FIG. 4. Next, the perpendicular fin shown at FIG. 4 is further rotated, towards the reader as viewed at FIG. 4, so as to assume the flat position shown at FIG. 5. This twisting about or spiral twisting of locking panels 30 and 32 causes corresponding twisting of the flexible sheet 14. In practice, the outermost ends of glassine type of paper 14 may not curl or be spiralled to the degree indicated at FIG. 4; however, the reader will understand that the opposite free ends of glassine type of paper 14 will also form a spiral of sorts. Lastly, from the flattened position at FIG. 5, the extending ends of the glassine type of paper are folded together and tucked beneath the hamburger.

The result of this tucking is shown at the left hand portion of FIG. 5, while the right hand portion of FIG. 5 shows the configuration of the glassine type of paper prior to the folding and tucking in operation.

From a consideration of FIGS. 3, 4 and 5 it will be observed that the wrapping of the wrapper 10 about the hamburger forms a tube, with locking panels 30 and 32 closing the free ends of the wrapper 10.

Figure 6:
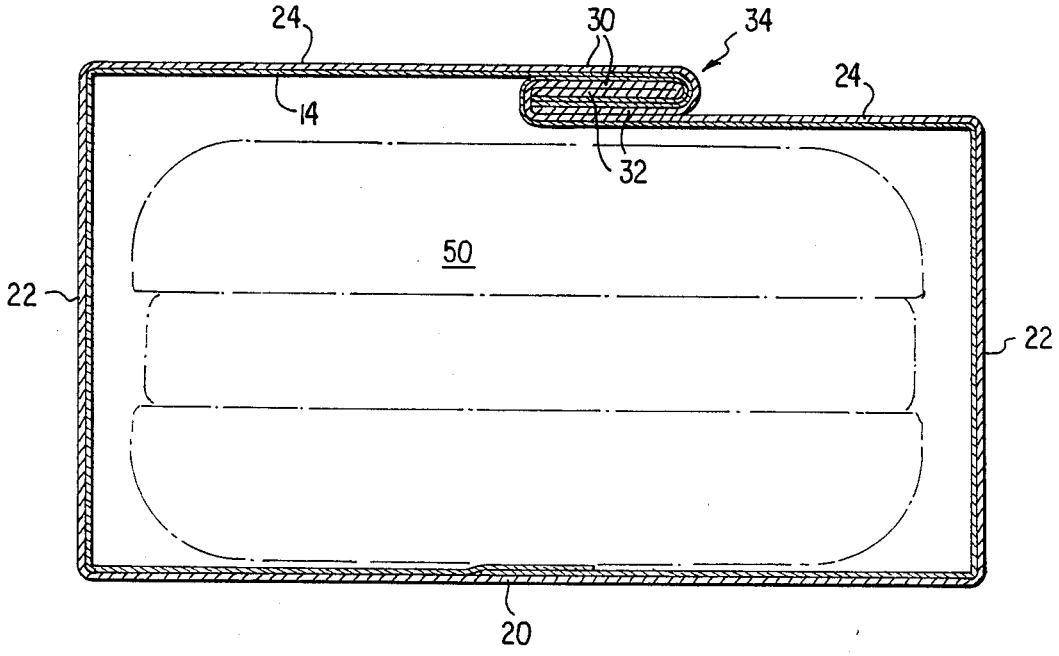
FIG. 6 is a cross-sectional view taken along section 6—6 of FIG. 5.
Figure 7:
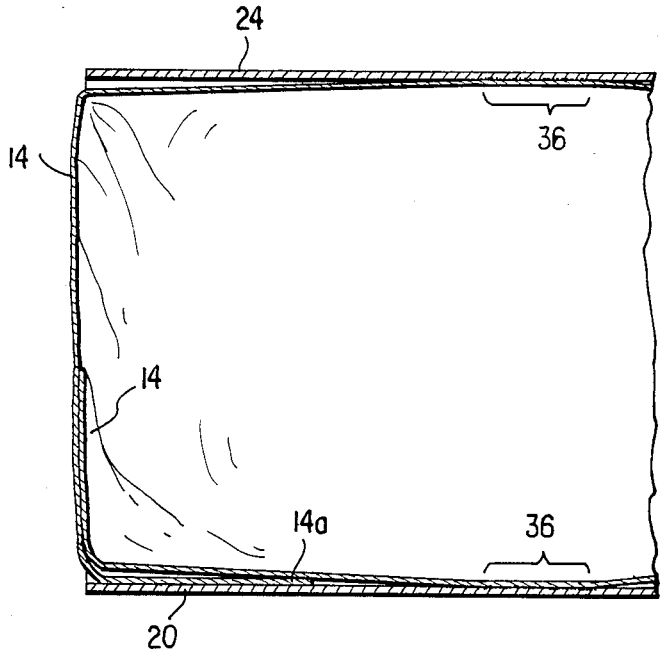
FIG. 7 is a view taken along section 7—7 of FIG. 5.

FIG. 6 illustrates a cross-section of the completed package, with the numeral 34 denoting the resultant and folded down fin, the fin defined by the spiralling about or wrapping about of locking tabs 30 and 32 as described above. FIG. 7 illustrates the tucking in of the crimped free edges of the glassine type of paper, the tucked in edges being denoted by the numeral 14*a*. The tucked in portion, as readily visualized by considering FIG. 7, lies between the top surface of bottom panel 20 and another portion of glassine type of paper. The tension of the tucked in ends of the glassine type of paper 14, illustrated at the left portion of FIG. 5 and FIG. 7, prevent the now spirally wound locking tabs 30 and 32 from unwinding. Thus, the locking panels 30 and 32 maintain the configuration illustrated at FIG. 6 until such time as it is desired to obtain access to the hamburger. When it is desired to obtain access to the food product, the user may either forcefully unwind the folded over fin assembly 34 shown at FIG. 6, or may pull out the tucked in portions of the glassine type of paper which close the ends of the wrapper tube, or both. The wrapper will now assume a somewhat flat position, such as illustrated at FIG. 2, with the glassine type of paper now serving the additional function as a kind of napkin or plate over which the food product may be consumed, if desired.

As illustrated in FIG. 7, the adhesive area 36 is relatively narrow and thereby defines a space to receive the tucked in portion 14*a* of the glassine type of paper. If the zone or region of adhesive 36 were substantially the entire width of the paperboard 12, there would be no space for portion 14 to be tucked in. Thus, in practicing this invention, adhesive zone 36 should be relatively narrow so as to define the required space for the reception of portions 14*a* of the glassine type of paper at each end of the tube defined by the folded and locked paperboard 12. As shown in the drawings, the zone of attachment of the flexible wrapper to the blank is located substantially at the mid-width of the blank, and the flexible sheet is narrower along its mid-length than at its ends. Also, the flexible sheet is secured to the blank substantially along the entire length of the blank.

Paperboard useful in making the wrapper will range between 12–16 points in caliper and is preferably clay coated to provide excellent graphics capability. The basis weight of the glassine type paper ranges between 20–60 lbs. per 3,000 square feet. Glassine type paper refers to a supercalendered, high density type of paper that is grease resistant and capable of retarding oil penetration.

Ordinarily, central panel 20 will be 4″ square for small burgers and 5″ square for larger burgers, lateral panels 22 will be 3″ high (when the package is erected), lateral panels 24 will be 2 or 2.5 inches for packaging small and large burgers, respectively. The glassine type paper is generally about 12 inches wide in its wide sections and about 10″ wide in its narrow section. The adhesive zone is approximately ½″ in width or wide enough to adhere the glassine type paper to the paperboard wrapper.

The advantage of the construction disclosed herein is that the glassine type paper conforms to the shape of the food product, which results in improved heat retention properties. The paperboard wrapper provides both protective strength and offers excellent graphics capabilities.

Generally speaking, the present invention is directed to a wrapper for forming a food package, the package comprising a food article, such as a hamburger, wrapped by a wrapper. The wrapper includes a generally rectangular blank formed of foldable, stiff and resilient sheet stock, such as paperboard. The blank comprises: a central panel adapted to form the bottom of the package; a pair of first lateral panels, each hinged at one respective end of the central panel and adapted to form the sides of the package; a second pair of lateral panels, each hinged to a respective end of a first lateral panel, the second lateral panels adapted to form the top of the package; means for joining the free ends of the second lateral panels; a flexible sheet, such as paper, secured to one surface of at least the central panel of the blank, the flexible sheet being of substantially the same length as the blank, extending beyond the side edges of the blank, and being secured to the central panel along a zone narrower than the width of the central panel. When the blank and flexible sheet are wrapped around a food product to thereby form a tube and the rectangular panel is on the outside and the flexible sheet is on the inside of the tube and contacting the food product, the edges of the flexible sheet can be folded to close the ends of the tube, thus covering the exposed portions of the food product and permitting the flexible sheet edges to be folded beneath the food product, between the food product and the central panel.

Although the invention has been described above by reference to a preferred embodiment, it will be appreciated that other package constructions may be devised, which are, nevertheless, within the scope and spirit of the invention and are defined by the claims appended hereto.

What is claimed is:

1. A wrapper for forming a food package, the package defined by a food article, such as a hamburger, wrapped by a wrapper, the wrapper including a generally rectangular blank formed of foldable, stiff and resilient sheet stock, such as paperboard, the blank having a central panel adapted to form the bottom of the package, a pair of first lateral panels each hinged at one respective end of the central panel and adapted to form the sides of the package, a second pair of lateral panels each hinged to a respective end of a first lateral panel, the second lateral panels adapted to form the top of the package, means for joining the free ends of the second lateral panels, a flexible sheet, such as paper, secured to one surface of at least the central panel of said blank, said flexible sheet being of substantially the same length as said blank, the flexible sheet extending beyond the side edges of said blank, the flexible sheet being secured to said central panel along a zone narrower than the width of the central panel, whereby when the blank and flexible sheet are wrapped around a food product to thereby form a tube, and the rectangular blank is on the outside and the flexible sheet is on the inside of the tube and contacting the food product, the edges of the flexibe sheet can be folded to close the ends of the tube, thus covering the exposed portions of the food product and permitting the flexible sheet edges to be folded beneath the food product, between the food product and the central panel.

2. The wrapper of claim 1 wherein the means for joining the free ends of the second lateral panels is defined by a pair of hinged locking panels at each free end of a lateral panel, the locking panels adapted to be placed on abutting, face to face relationship, the locking panels adapted to be twisted in a spiral manner until they are in substantial parallelism with the top of the package when the wrapper is placed around a food product.

3. The wrapper of claim 1 wherein the flexible sheet is secured to the blank substantially along the entire length of the blank.

4. The wrapper of claim 3 wherein the zone of attachment of the flexible wrapper to the blank is located substantially at the mid-width of the blank.

5. The wrapper of claim 1 wherein the flexible sheet is narrower along its mid-length than at its ends.

6. The wrapper of claim 1 wherein the flexible paper sheet is provided with a cutout along a major portion of its top and bottom edges.

7. A food package defined by a food product and a wrapper, the wrapper being in the form of a tube having bottom, side and top walls, the wrapper defined by a two layered laminate, one layer being an external layer and the other layer being an internal layer, the top wall defined by joined ends of the laminate, the exterior and interior layers being circumferentially coextensive, the external layer being formed of a single piece of foldable, stiff and resilient sheet stock, such as paperboard, the inner layer being a flexible sheet, such as glassine type of paper, the flexible sheet extending beyond both edges of the sheet stock with the extending flexible sheet portions being tucked in between an exterior surface portion of the food product and an interior wall of the sheet stock, the two layers of the laminate being adhered together over a zone narrower than the width of the sheet stock at least at said interior wall of the sheet stock, to thereby define spaces between the food product exterior surface and said interior wall of the sheet stock, the spaces receiving the tucked-in flexible sheet portions.

8. The food package of claim 7 wherein the glassine type paper is provided with a cutout along a major portion of its top and bottom edges.

9. The food package of claim 7 wherein said interior wall of the sheet stock is the bottom wall of the tube.

10. The food package of claim 7 wherein said narrower zone extends around the entire inner circumference of the sheet stock.

11. The food package of claim 7 wherein the means for joining the two circumferential ends of the laminate together is defined by pair of foldable locking panels at each external layer end, the locking panels and the flexible sheet portions carried thereby being in face to face relationship and being spirally twisted about their fold axes to assume a position substantially parallel to the top wall, whereby the tension from the tucked-in flexible sheet portions maintains the locking panels in this position to thereby keep the food package closed.

* * * * *